United States Patent [19]

Croll

[11] 4,244,585

[45] Jan. 13, 1981

[54] ARCHERY TARGET

[76] Inventor: Lionel Croll, c/o Lionel Supply & Manufacturing Company, 1325 Walnut St. - Suite 1108, Philadelphia, Pa. 19107

[21] Appl. No.: 82,012

[22] Filed: Oct. 5, 1979

Related U.S. Application Data

[63] Continuation-in-part of Ser. No. 778,005, Mar. 16, 1977, Pat. No. 4,126,501, and Ser. No. 872,510, Jan. 26, 1978, abandoned.

[51] Int. Cl.[3] ..... F41J 3/00

[52] U.S. Cl. ..... 273/408; 156/183; 156/213; 428/37; 428/222; 428/906

[58] Field of Search ..... 273/403, 404, 408, 410; 156/182, 183, 184, 213; 138/128, 121; 93/1 WZ; 428/906, 37, 222

[56] References Cited

U.S. PATENT DOCUMENTS

| | | | |
|---|---|---|---|
| 2,423,347 | 7/1947 | Saunders | 273/408 |
| 2,818,258 | 12/1957 | Stern | 273/404 |
| 2,990,179 | 6/1961 | Barna | 273/408 |
| 3,650,877 | 3/1972 | Johnson | 156/183 X |
| 3,900,778 | 8/1975 | Bruner | 273/403 |
| 4,026,198 | 5/1977 | Ottaviano | 93/1 WZ |
| 4,121,959 | 10/1978 | Meyer | 273/403 X |

FOREIGN PATENT DOCUMENTS

| | | | |
|---|---|---|---|
| 109530 | 1/1944 | Sweden | 273/408 |
| 11604 | 5/1911 | United Kingdom | 273/404 |
| 350250 | 6/1931 | United Kingdom | 273/408 |
| 462562 | 3/1937 | United Kingdom | 273/408 |
| 730508 | 5/1955 | United Kingdom | 273/408 |

*Primary Examiner*—Paul E. Shapiro
*Attorney, Agent, or Firm*—Robert K. Youtie

[57] ABSTRACT

An archery target wherein a thermoplastic plastic film web is randomly gathered transversely and wound spirally into a disc-like formation with successive convolutions in engagement and combining to define interstitial openings or air pockets. The spiral convolutions may be kept from unwinding in a number of different ways including heat sealing of adjacent convolutions, covering the faces of the disc with an adhesively or heat sealingly secured cover sheet extending in gathered relation through the center of the disc and splayed outwardly onto the opposite faces, or backing one disc with another having oppositely wound convolutions and securing the abutting edges of the convolutions to each other or an intermediate sheet.

11 Claims, 6 Drawing Figures

ARCHERY TARGET

CROSS REFERENCES TO RELATED APPLICATIONS

This is a continuation-in-part of my copending patent application Ser. No. 778,005, filed Mar. 16, 1977 entitled Archery Target and Method of Making Same, now U.S. Pat. No. 4,126,501, and a continuation-in-part of my copending patent application Ser. No. 872,510, filed Jan. 26, 1978 entitled Archery Target now abandoned.

BACKGROUND OF THE INVENTION

The device of the present invention has been primarily developed and employed as an archery target, and will be illustrated and described hereinafter with particular reference thereto, while it is understood that the invention is capable of many varied applications all of which are intended to be comprehended herein.

As is well known to those versed in the field of archery, targets are now generally constructed of excelsior, cardboard and other materials, and such targets are relatively expensive and short lived, especially in tournament use, and the like, where the target center is frequently impaled. While certain improvements have been proposed, such as the use of removable and replaceable central target portions or "bull's-eyes", these proposals have not been entirely satisfactory, primarily adding to costs both initially and in continuing maintenance.

SUMMARY OF THE INVENTION

It is an important object of the present invention to provide an archery target which overcomes the problems of the previous paragraph, providing substantially increased useful life, even under severe conditions of tournament use, so as to considerably reduce required maintenance and replacement, and effect substantial savings in cost while affording improved quality of targets to users throughout the increased life.

It is a more particular object of the present invention to provide a target and method of manufacture wherein plastic sheeting or film is gathered or bunched to define internal air pockets or interstitial openings, which structure serves by the thermoplastic nature of the sheeting to quickly dissipate and effectively retard projectile movement upon impaling or penetration, while the interstices serve to alleviate heat build-up, and assure a sufficient softness or cushioning by the target to assure impaling thereby and holding therein even of relatively lightweight and slow moving projectiles.

It is among the further objects of the present invention to provide a unique target center or core structure which provides the above mentioned advantageous characteristics and further enhances the longevity of the central target area.

Another object of the present invention resides in the provision of alternately oppositely wound spiral coiled discs in facing relation with each other in an archery target, each serving to effectively resist uncoiling of the adjacent disc by the nature of the oppositely oriented spiral convolutions.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figure 1:
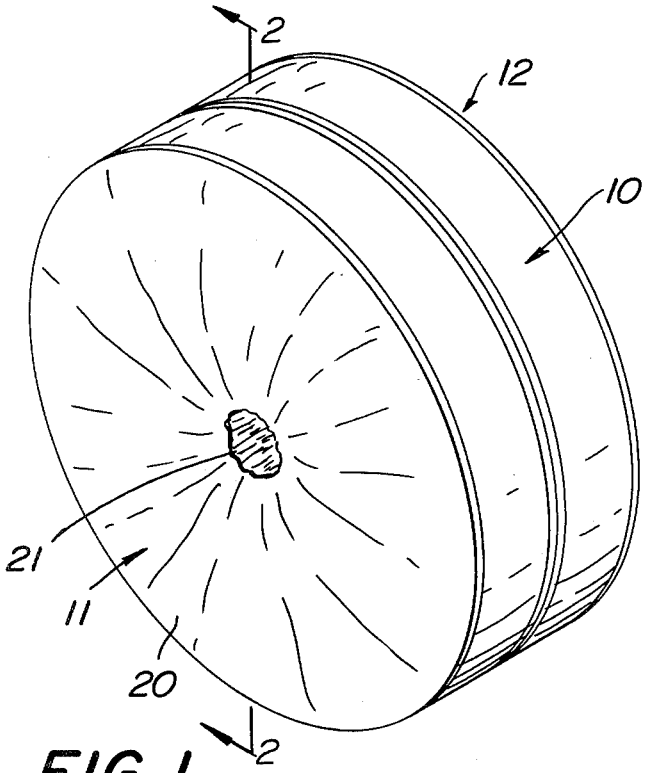
FIG. 1 is a perspective view showing an archery target constructed in accordance with the teachings of the instant invention.
Figure 2:
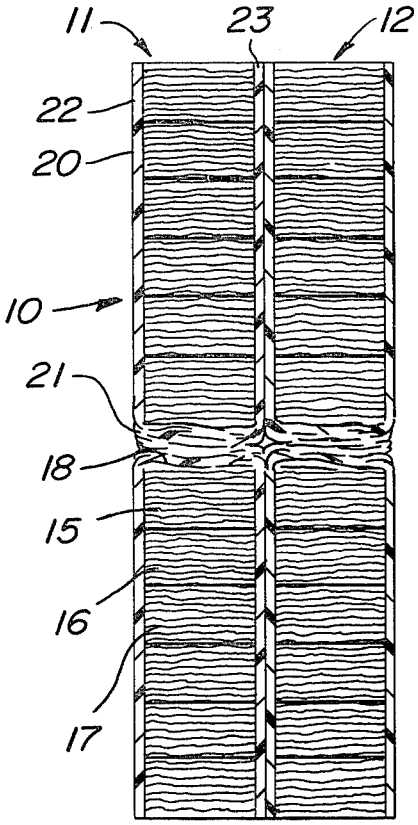
FIG. 2 is a sectional view taken generally along the line 2—2 of FIG. 1.
Figure 3:
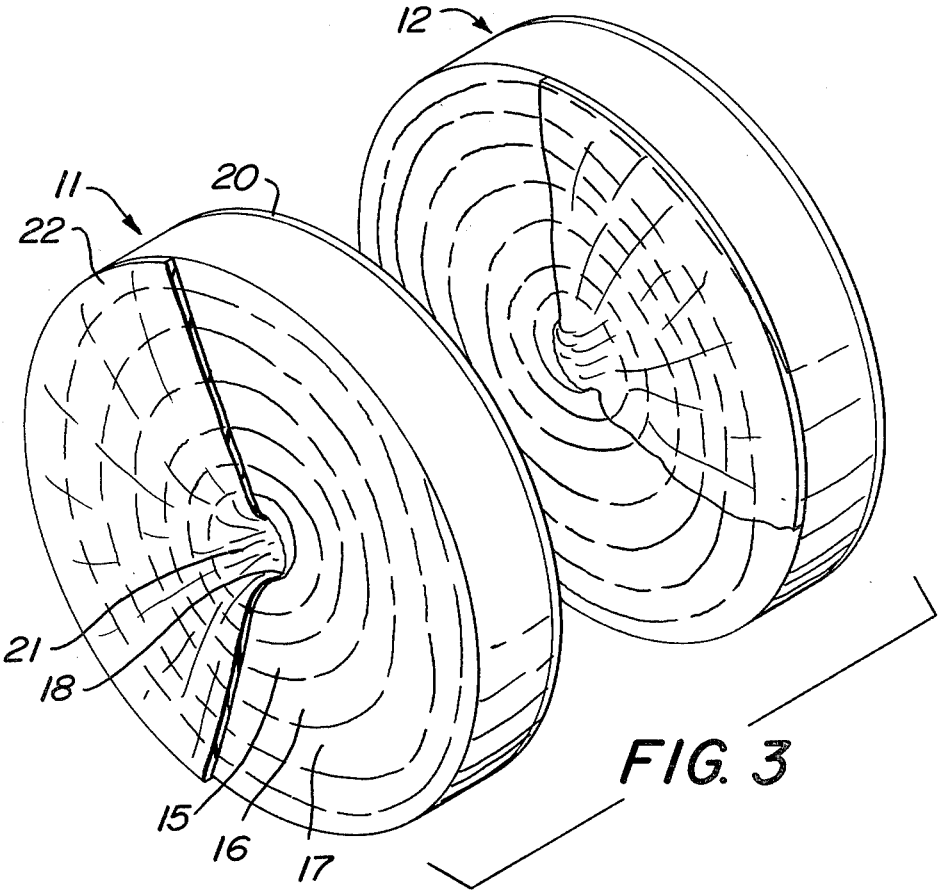
FIG. 3 is an exploded perspective view of the target of FIGS. 1 and 2.

Referring now more particularly to the drawings, and specifically to FIGS. 1–3 thereof, an archery target is there generally designated 10, being composed of a pair of spirally wound discs 11 and 12 disposed in facing relation with each other. Each of the discs 11 and 12 may be formed by the method and apparatus described in said co-pending patent and may constitute a generally coplanar spiral or series of continuous convolutions, as at 15, 16 and 17. A single elongate, separate piece of flexible plastic film is pulled through a constriction to effect random gathering of the film transversely, and is then wound upon itself to have successive convolutions in adjacent engaging relation and thereby define a disc having a multitude of random interstices or internal air pockets. The innermost convolution 15 may circumscribe or bound there within a central opening 18. As the continuing convolutions 15–17 of the disc 11 are formed of a continuous web of gathered flexible sheet material or plastic film, it will be appreciated that the disc defines therewithin a multitude of interstices or air pockets. The spirally coiled disc 11 may advantageously be subjected to heating, as in an oven, by radio frequency or other, to effect a degree of sealing between engaging surfaces of successive convolutions, so as to define of the interstices a multitude of air pockets affording a yieldable resilience and firmness to the body or disc 11. A selected degree of firmness of the disc 11 may be achieved by circumferentially wrapping the disc to a selected tightness during the partial heat sealing. This partial heat sealing may thereby serve to retain the form of the spirally wound disc 11, if desired.

Either with or without the above described partial heat sealing for form retention, other modes of disc-form retention may be employed, as by various coverings, or the like.

In one form, a flexible covering sheet 20, say of thermoplastic film, may be gathered at an intermediate region, as at 21, and in its gathered or constricted condition inserted through the central disc opening 18. Thus, the constricted or gathered plastic film portion 21 defines a central core or plug for closing the central disc opening 18. The remaining film or sheet portions 22 and 23 of covering sheet 20, extending outwardly from opposite ends of the central through opening or bore 18 onto opposite sides of the disc 11, are spread or splayed generally radially throughout 360°. The radially extending or splayed covering sheet portions 22 and 23 may be suitably secured in adhesive engagement with respective faces of the coiled disc 11, as by suitable adhesive means, including partial heat sealing or other, as desired. Thus, with the spirally wound disc 11 suitably bound or girded to a desired firmness or tightness, the covering sheet 20 may be gathered for extension through the central hole 18, as at 21, and splayed into facing engagement with opposite disc faces, as at 22 and 23, and subjected to partial heat sealing, as by timed heating in an oven, or other. By this means, the flexible sheet 20 may serve to retain the desired form of the disc.

The disc 12 may be substantially identical to the disc 11, being spirally wound of gathered flexible sheeting or plastic film and provided with suitable form retaining means such as that described hereinbefore.

However, the coiled disc 12 has its convolutions wound in angularly opposite relation with respect to that of the coils of disc 11. That is, the coiled discs 11 and 12 are oriented with respect to each other so that in their facing relation their convolutions extend in opposite angular directions. With the discs 11 and 12 secured together in the above-described orientation, it will be apparent that any tendency of one disc to unwind will inherently be resisted by the other disc, as unwinding of one disc would exert a winding force on the other disc.

As the disc 12 may be substantially identical to the disc 11, detailed description of the former would be repetitious and therefore unnecessary. The discs 11 and 12 may be secured in their facing relation by any suitable means, such as adhesive, or by heat sealing, say by placing the pair of discs together in their facing engagement into a heating environment.

While the illustrated embodiment shows a splayed covering sheet (designated 20 of disc 11) on both discs, it is appreciated that such covering sheet may be absent from one or both discs. Further, a single covering sheet may be employed in operative association with a plurality of discs in facing engagement with each other, by the extension of the gathered medial sheet region through the aligned central bores or opening of the facing discs, and splaying of the remaining sheet portions on the outer sides of the outermost discs. Oppositely wound discs may obtain the mutually retaining advantage (unwinding of each disc being resisted by unwinding of the other), either with or without an interposed covering sheet 20. If such covering sheet is interposed, actual usage effects destruction by repeated impaling to rapidly deteriorate the covering sheet to very little strength while the oppositely wound convolutions are still connected together to exert winding forces on each other.

Figure 4:
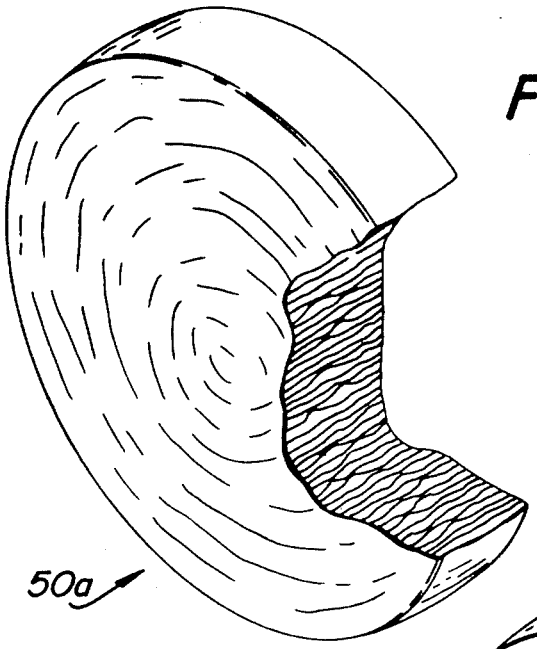
FIG. 4 is a perspective view showing another embodiment of target construction of the present invention, broken away to illustrate the interior.

In FIG. 4 is shown a coil or disc 50a, which may be substantially identical to the discs 11 and 12 of FIGS. 1–3, but without covering sheets. The disc 50a may have been subjected to sufficient heat to cause partial heat sealing of the successive, engaging convolutions. Such heat sealing may be by timed heating in an oven, radio frequency or other. The relatively small central opening or bore formed in the hub of the coil 50a may be allowed to close of itself upon removal from a winding shaft, or may be closed by the insertion of a filler or plug, if desired.

Figure 5:
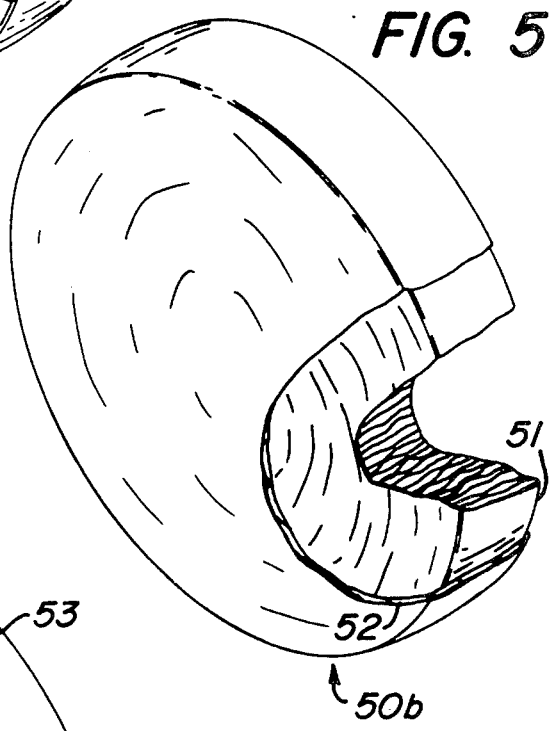
FIG. 5 is a perspective view showing another slightly modified embodiment broken away to show internal construction.

Considering the embodiment shown in FIG. 5, a cylindrical form or disc 50b may include an inner body 51 as removed from a winding shaft or reel, and an outer covering or casing 52 encompassing the body 51 and effectively retaining the desired cylindrical or disc shape and form. The outer covering may be of plastic sheeting, as illustrated, and further the combined disc shaped body and outer covering 52 may be subjected to heat sealing to achieve adherence of adjacent plastic film portions. However, advantageous results are achieved without heat sealing of the embodiment of FIG. 5; and further, the encompassing cover 52 may not be closed, as illustrated, but may be of an openwork net-like character, or may be coated with contact adhesive for adherence to the exterior of inner body 51. For example, adhesive strips may be employed, say radially and circumferentially, over the exterior of body 51, if desired.

Figure 6:
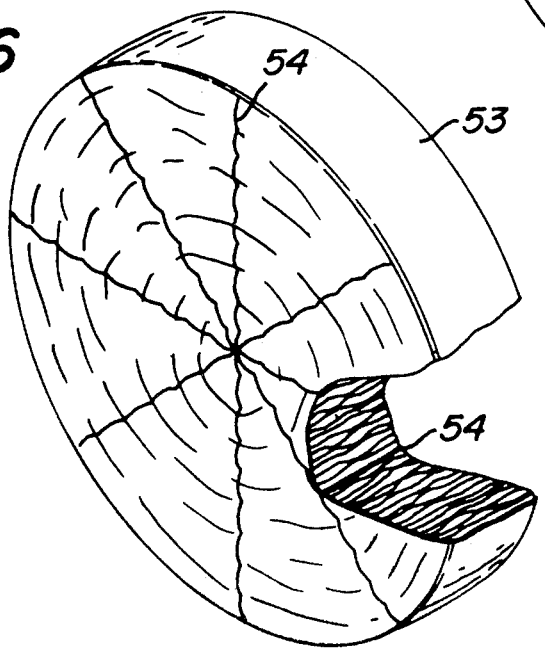
FIG. 6 is another perspective view showing further embodiment broken away to illustrate interior structure.

An additional embodiment is shown in FIG. 6, wherein a spirally wound body 53 may be removed from a winding wheel or shaft, and the cylindrical or disc-like configuration retained by other means, such as stitching 54 penetrating transversely of the body 53 and extending radially or otherwise, as desired.

From the foregoing, it is seen that the present invention provides substantial improvements in archery target structures, greatly simplifying manufacturing to effect substantial cost reductions, while considerably extending the target life and quality in use.

Although the present invention has been described in some detail by way of illustration and example for purposes of clarity of understanding, it is understood that certain changes and modifications may be made within the spirit of the invention.

What is claimed is:

1. A target construction comprising an elongate single piece of flexible separate plastic film randomly gathered transversely and extending in a planar spiral configuration under longitudinal tension and having convolutions in adjacent engaging relation to define a disc having a random multitude of internal air pockets, and form retaining means associated with said disc to retain the configuration thereof.

2. A target construction according to claim 1, said form retaining means comprising a covering.

3. A target construction according to claim 1, said form retaining means comprising stitching.

4. A target construction according to claim 1, said form retaining means comprising adherent means on the exterior of said disc securing together outer regions of adjacent convolutions.

5. A target construction according to claim 4, said adherent means comprising adhesive coated flexible sheet material.

6. A target construction according to claim 4, said film being thermoplastic, and said adherent means comprising thermoplastically heat sealed adjacent engaging portions of said convolutions.

7. A target construction according to claim 1, said film being thermoplastic, said form retaining means comprising a thermoplastic cover on said disc, and said cover being heat sealed to said convolutions.

8. A target construction according to claim 1, in combination with a second elongate single piece of separate plastic film randomly gathered transversely and extending in a planar spiral configuration under longitudinal tension and having convolutions in adjacent engaging relation to define a second disc having a random multitude of internal air pockets, said first and second discs having the convolutions extending in opposite angular directions and secured together in facing relation, whereby unwinding of the convolutions of each disc is resisted by the oppositely wound convolutions of the other disc.

9. A target according to claim 8, said form retaining means comprising a flexible sheet extending in gathered relation centrally through at least one of said discs and splayed outwardly on opposite sides thereof.

10. A target construction comprising a coil of gathered plastic film having convolutions in adjacent engaging relation to define a disc having internal air pockets, and form retaining means associated with said disc to retain the configuration thereof, said form retaining means comprising a flexible sheet extending in gathered relation centrally through said coil and splayed outwardly onto opposite sides of said coil and secured thereto.

11. A target construction according to claim 10, said flexible sheet being adherently secured to the faces of said opposite coil sides.

* * * * *